US008740722B2

(12) United States Patent
Sato

(10) Patent No.: US 8,740,722 B2
(45) Date of Patent: Jun. 3, 2014

(54) CLUBHEAD OF IRON GOLF CLUB

(75) Inventor: Fumiaki Sato, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 309 days.

(21) Appl. No.: 13/232,168

(22) Filed: Sep. 14, 2011

(65) Prior Publication Data

US 2012/0064997 A1 Mar. 15, 2012

(30) Foreign Application Priority Data

Sep. 15, 2010 (JP) ..... 2010-206909

(51) Int. Cl.
*A63B 53/04* (2006.01)

(52) U.S. Cl.
USPC ..... 473/334; 473/350; 473/349

(58) Field of Classification Search
USPC ..... 473/334, 350, 349
See application file for complete search history.

(56) References Cited

U.S. PATENT DOCUMENTS

| | | | | |
|---|---|---|---|---|
| 6,929,563 | B2 * | 8/2005 | Nishitani | 473/334 |
| 7,621,822 | B2 * | 11/2009 | Roach | 473/329 |
| 2002/0165041 | A1 * | 11/2002 | Takeda | 473/334 |
| 2003/0139226 | A1 * | 7/2003 | Cheng et al. | 473/334 |

FOREIGN PATENT DOCUMENTS

JP 2009-112800 A 5/2009

* cited by examiner

*Primary Examiner* — Benjamin Layno
(74) *Attorney, Agent, or Firm* — Sughrue Mion, PLLC

(57) ABSTRACT

A clubhead of an iron golf club includes: a head main body including a face portion and a hosel portion; a back member including a sole surface and a back surface; and a fixing member configured to detachably fix the back member to the head main body.

18 Claims, 13 Drawing Sheets

CLUBHEAD OF IRON GOLF CLUB

BACKGROUND

1. Field of the Invention

The present invention relates to a clubhead of an iron golf club and more particularly to a clubhead of an iron golf club which has a head main body which includes a face surface and a hosel portion and a back member which is detachably attached to the head main body and in which a sole bounce angle and a sole shape can be changed by changing back members.

2. Description of the Related Art

JP-A-2009-112800 describes, as a clubhead of an iron golf club whose sole bounce angle can be adjusted, a clubhead of an iron golf club in which a back and a sole portion can be inclined to the rear. As is shown in FIG. 3 of JP-A-2009-112800, a face portion is integrally continuous with a plate-shaped back portion via the sole portion, and this plate-shaped back portion can be inclined to the rear about the sole portion (which is referred to as a hinge portion in JP-A-2009-112800) as a rotational center. The plate-shaped back portion is fixed at a predetermined inclined angle by a bolt.

In the clubhead of the iron golf club described in JP-A-2009-112800, although the sole bounce angle can be adjusted, neither the shape of a sole nor the shape of the back portion can be changed.

In addition, in the clubhead of the iron golf club in JP-A-2009-112800, when the sole bounce angle is changed a plurality of times, a connecting portion between the face portion, which is referred to as the hinge portion in JP-A-2009-112800, and the plate-shaped back portion is repeatedly subjected to a plastic deformation, whereby cracks are generated in the connecting portion to fail in the end.

SUMMARY

An object of the invention is to provide a clubhead of an iron golf club in which not only a sole bounce angle but also the shape of a back portion can be changed and in which the sole bounce angle can be changed repeatedly.

According to an aspect of the invention, there is provided a clubhead of an iron golf club including: a head main body including a face portion and a hosel portion; a back member including a sole surface and a back surface; and a fixing member configured to detachably fix the back member to the head main body.

The back member may be located at a central portion of the clubhead in a toe-to-heel direction.

A length of the back member in the sole surface with respect to the toe-to-heel direction may be in a range of 25 to 80 mm.

A height of an intermediate portion of the back member may be lower than a height of a toe-side portion of the back member and a height of a heel-side portion of the back member.

A recess may be provided in a head main body side surface of the intermediate portion of the back member.

A toe side, a heel side and a face portion side of the sole surface of the clubhead may be defined by a sole surface of the head main body, and a portion of the sole surface of the clubhead, which is surrounded by the toe side, the heel side and the face portion side of the sole surface, may be defined by a sole surface of the back member.

A part of the sole surface of the back member may project toward a downside of the sole surface of the head main body.

A part of the sole surface of the back member may recede toward an upside of the sole surface of the head main body.

An intermediate portion of the sole surface of the back member with respect to a face-to-back direction may project toward a downside of a face-side portion and a back-side portion of the surface of the back member.

The fixing member may be a bolt.

A projecting portion may be provided at a part of a back surface of the head main body, a recess hole may be provided in a front surface of the back member so that the projecting portion fits the recess hole, a bolt insertion hole may be provided so as to pass from the recess hole to a back surface of the back member, and the back member may be fixed to the head main body when the bolt, passed through the bolt insertion hole, is screwed into an internally threaded hole provided in the projecting portion.

In the clubhead of the iron golf club of the invention, the head main body is separated from the back member, and the back member is detachably attached to the bead main body. Therefore, the bounce angle of the sole, the shape of the sole and the shape of the back portion can be changed variously by replacing back members of various shapes. In addition, when the back member is damaged, the damaged back member can also be replaced with a back member of the same shape.

In the invention, the back member is separated from the head main body, and the back member is designed to be replaced with back members of different shapes. Therefore, although the iron golf club described in JP-A-2009-112800 fails when the shape of the clubhead thereof is changed repeatedly, the clubhead of the iron golf club of the invention is free from such a failure. Therefore, the shape of the clubhead of the iron golf club of the invention can be changed in many ways and many times.

The back member may constitute the whole of the sole portion and the back portion of the clubhead of the iron golf club or may constitute only the central portion with respect to the toe-to-heel direction. In the latter case, the length of the back member with respect to the toe-to-heel direction is preferably in the range of 25 to 80 mm.

The lower portion or the recess portion is provided in the intermediate portion of the upper portion of the back member with respect to the toe-to-heel direction, whereby the center of gravity of the clubhead of the iron golf club can be lowered or the sweet area can be expanded in the toe-to-heel direction. In addition, the recess portion is provided in the surface of the back member which faces the head main body, whereby the depth of the center of gravity of the clubhead of the iron golf club can be made deeper.

In this invention, the toe side portion, the heel side portion and the face portion side portion of the sole surface of the clubhead of the iron golf club may make up the sole surface of the head main body, and the portion surrounded thereby may make up the sole surface of the back member. As this occurs, at least part of the sole surface of the back member may be formed so as to project further downwards or to recede further upwards than the sole surface of the head main body.

In the invention, the intermediate portion of the sole surface of the back member with respect to the face-to-back direction may project further downwards than the face side portion and the back side portion thereof.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Hereinafter, embodiments of the invention will be described by reference to the drawings.

Figure 1:
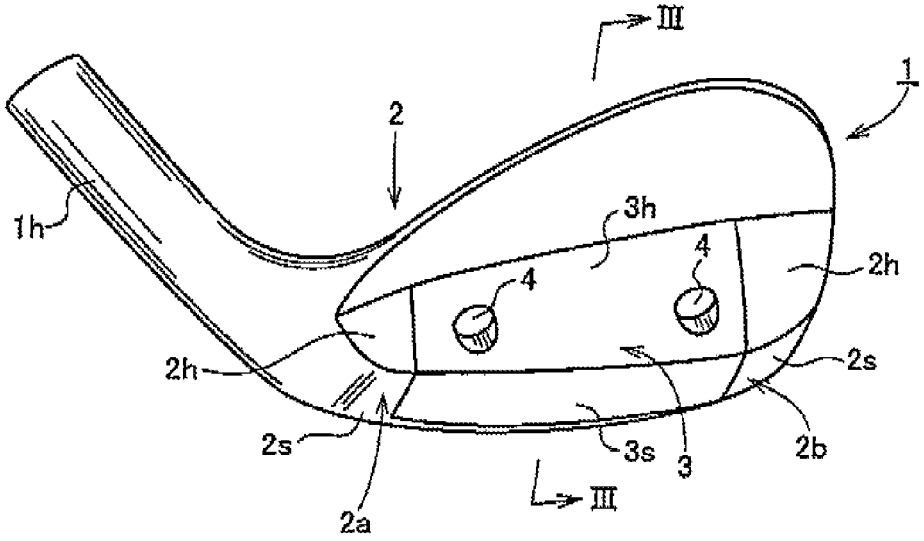
FIG. 1 is a perspective view of a clubhead of an iron golf club according to an embodiment of the invention as seen from the rear and below thereof.
Figure 2:
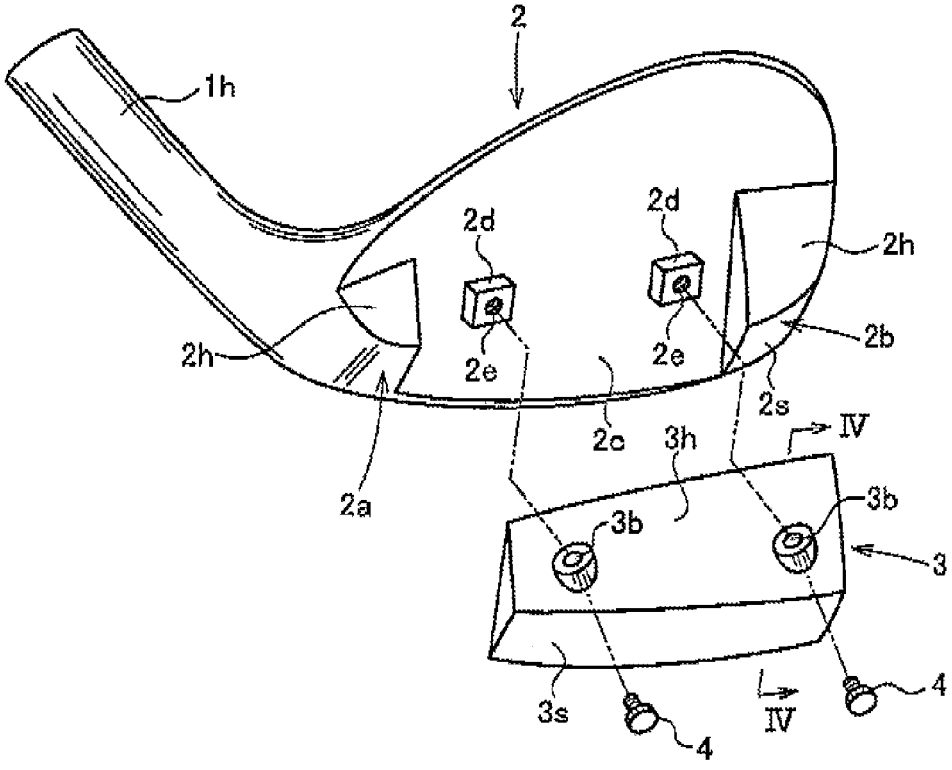
FIG. 2 is an exploded perspective view of the clubhead of the iron golf club shown in FIG. 1.
Figure 3:
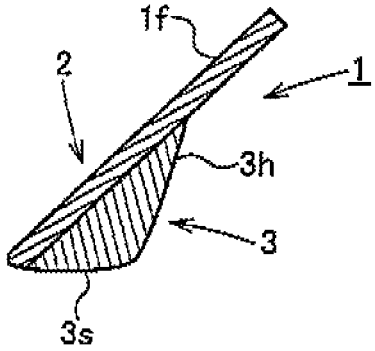
FIG. 3 is a sectional view taken along the line III-III in FIG. 1.
Figure 4:
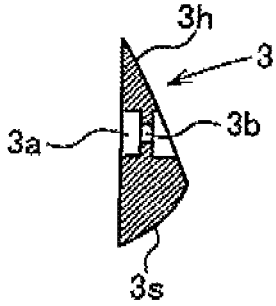
FIG. 4 is a sectional view taken along the line IV-IV in FIG. 2.
Figure 5:
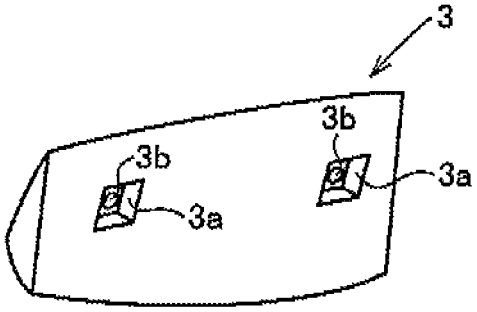
FIG. 5 is a perspective view of the clubhead of the iron golf club shown in FIG. 1 as seen from a front surface side of a back member.

FIGS. 1 to 5 show a clubhead of an iron golf club according to an embodiment of the invention. FIG. 1 is a perspective view of a clubhead of an iron golf club as seen from the rear and below thereof, FIG. 2 is an exploded perspective view thereof, FIG. 3 is a sectional view taken along the line in FIG. 1, FIG. 4 is a sectional view taken along the line IV-IV in FIG. 2, and FIG. 5 is a perspective view of the clubhead of the iron golf club as seen from a front surface side of a back member.

A clubhead 1 of an iron golf club shown in the figures is a clubhead of an iron golf club generally referred to as a wedge having a loft angle of the order of 40 to 60°. However, the invention can be applied to clubheads of iron golf clubs having loft angles of the order of 20 to 60° which are referred to as long irons, middle irons or short irons. This clubhead 1 of the iron golf club includes a head main body 2 having a face surface 1*f* and a hosel portion 1*h* and a back member 3 which is detachably attached to the head main body 2. A hosel hole (not shown) is provided in the hosel portion 1*h*. A shaft (not shown) of the golf club is inserted into the hosel hole and is secured in place therein with an adhesive.

In this embodiment, a heel-side protuberant portion 2*a* and a toe-side protuberant portion 2*b* are provided at a heel side (a side facing the hosel portion 1*f*) and a toe side of the head main body 2, respectively. Bottom surfaces of the heel-side protuberant portion 2*a* and the toe-side protuberant portion 2*b* constitute part of a sole surface of the clubhead 1 of the iron golf club. Back surfaces 2*h* of the heel-side protuberant portion 2*a* and the toe-side protuberant portion 2*b* constitute part of a back surface of the clubhead 1 of the iron golf club.

A portion of the head main body 2 which lies between the heel-side protuberant portion 2*a* and the toe-side protuberant portion 2*b* constitutes a flat surface 2*c* which is flush with the remaining back surface of the head main body 2, and one or a plurality of projecting portions 2*d* are provided on this flat surface.

Two projecting portions 2*d* are preferably provided on the flat surface. In this embodiment, two projecting portions 2*d* are provided so as to be spaced apart from each other in a toe-to-heel direction. An internally threaded hole 2*e* is provided in a back surface portion of each of the projecting portions 2*d*.

The back member 3 is sized so as to fit between the protuberant portions 2*a*, 2*b*. A front surface of the back member 3 is made into a flat surface which is superposed on the flat surface 2*c* of the head main body 2 in a closely attached fashion. In addition, recess holes 3*a* (FIGS. 4, 5) are provided in the front surface of the back member 3 so that the projecting portions 2*d* fit therein. The same number of recess holes 3*a* as that of the projecting portions 2*d* are provided.

In each of the recess holes 3*a*, a bolt insertion hole 3*b* is provided so as to pass through the back member 3 from the recess hole 3*a* to a back surface of the back member 3. The back member 3 is brought into engagement with a rear surface of the head main body 2 with the projecting portions 2*d*, 2*d* fitted in the corresponding recess holes 3*a*, 3*a*, and bolts 4 are screwed into the internally threaded holes 2*e* through the bolt insertion holes 3*b*, whereby the back member 3 is fixed to the head main body 2. In addition, the back member 3 can be separated from the head main body 2 by removing the bolts 4 from the corresponding internally threaded holes 2*e*.

With the back member 3 fixed to the head main body 2, the back surface 3*h* of the back member 3 constitutes a surface which is continuously flush with the back surfaces 2*h* of the protuberant portions 2*a*, 2*b* of the head main body 2. In addition, a sole surface 3*s* of the back member 3 constitutes a surface which is continuously flush with sole surfaces 2*s* of the protuberant portions 2*a*, 2*b* of the head main body 2.

In the case of a normal wedge, a length of the back member 3 at the sole surface 3*s* with respect to a toe-to-heel direction is preferably of the order of 25 to 80 mm and is more preferably of the order of 40 to 70 mm.

In the clubhead of the iron golf club which is configured as has been described above, the back member 3 is detachably attached to the head main body 2. Therefore, when the back member 3 is replaced with a back member 3 having a different shape, the shape of a sole portion or the shape of a back portion of the clubhead can be changed variously. In addition, the height or depth of the center of gravity of the clubhead of the iron golf club can be changed variously.

In this embodiment, the back member 3 is disposed so as to be fittingly held between the protuberant portions 2*a*, 2*b* of the head main body 2, and the projecting portions 2*d* on the head main body 2 fit in the corresponding recess holes 3*a* in the back member 3, whereby the back member 3 is fixed firmly to the head main body 2.

Figure 6:
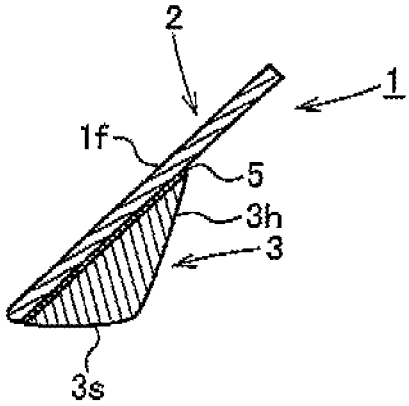
FIG. 6 is a sectional view of a clubhead of an iron golf club according to another embodiment of the invention.

In this embodiment, the front surface of the back member 3 is superposed on the back surface of the head main body 2, and therefore, the back member 3 is fixed firmly to the head main body 2. In addition, as is shown in FIG. 6, a spacer 5 may be interposed between a head main body 2 and a back member 3, and as this occurs, the spacer 5 is formed of a synthetic resin, rubber or elastomer. By adopting this configuration, the close attachment of the back member 3 to the head main body 2 can be increased, and vibrations can be absorbed that would be generated when a shot is made (when a ball is hit).

Referring to FIGS. 7A to 16B, back members having different shapes will be described.

Figure 7A:
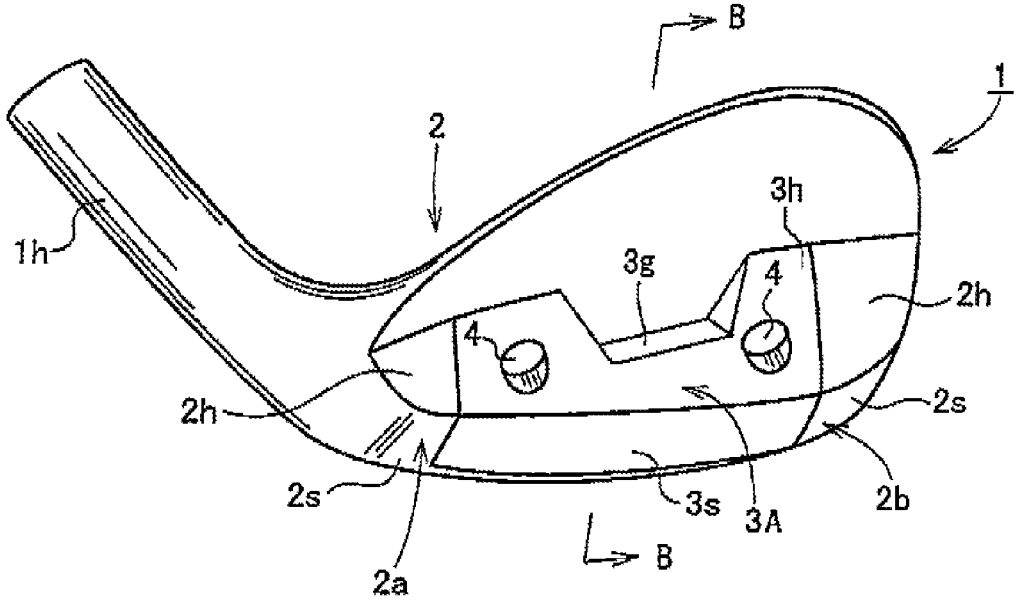
FIGS. 7A to 7C show explanatory drawings depicting a clubhead of an iron golf club having a different back member.
Figure 7B:
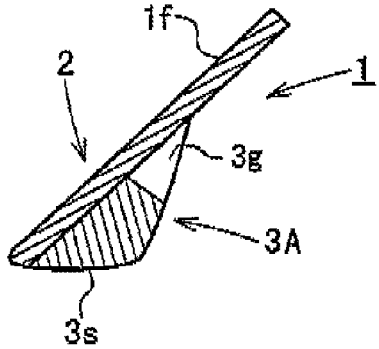
Figure 7C:
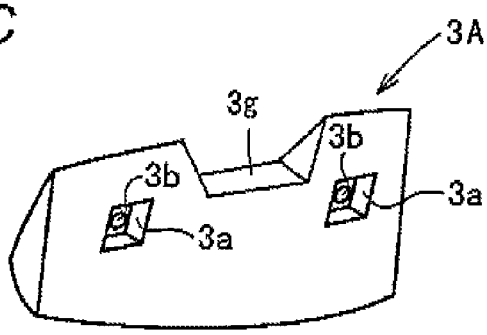
Figure 8A:
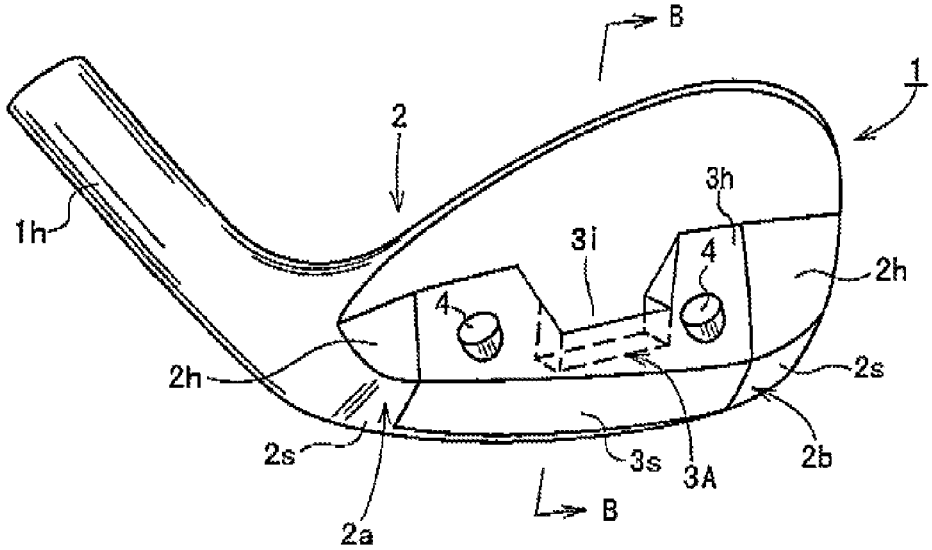
FIGS. 8A to 8C show explanatory drawings depicting a clubhead of an iron golf club having a different back member.
Figure 8B:
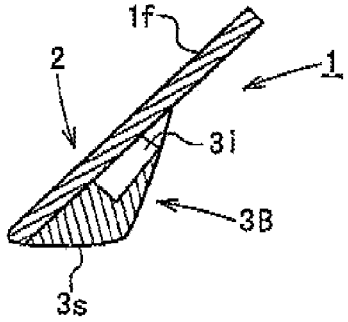
Figure 8C:
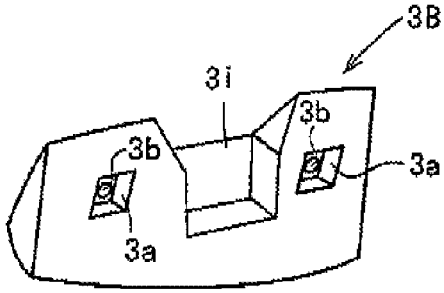

FIGS. 7A to 8C show clubheads of iron golf clubs which have back members 3A, 3B in place of the back member 3. In each of the figures, a perspective view of a clubhead of an iron golf club as seen from the rear and below thereof is shown in FIGS. 7A and 8A, a sectional view taken along the line B-B at FIGS. 7A and 8A is shown in FIGS. 7B and 8B, and a perspective view of a back member as seen from the front is shown in FIGS. 7C and 8C.

A back member 3A used in a clubhead of an iron golf club shown in FIGS. 7A to 7C includes a lower portion 3*g* which is provided at an intermediate portion of an upper portion thereof with respect to the toe-to-heel direction, and this lower portion 3*g* is made lower than a toe-side portion and a heel-side portion of the back member 3A.

In a back member 3B shown in FIGS. 8A to 8C, a recess portion 3*i* which recedes downwards is provided in a front surface side of the back member 3B in place of the lower portion 3*g*.

The other configurations of the back members 3A, 3B remain the same as those of the back member 3, and like reference numerals are given to denote like constituent portions to those of the sole member 3.

The center of gravity of the clubhead of the iron golf club is lowered by providing the lower portion 3*g* or the recess portion 3*i* in the way described above. In addition, the weight of the clubhead of the iron golf club is also reduced. Further, the sweet area of the clubhead of the iron golf club is expanded to the toe side and the heel side. In the case of the recess portion 3*i* being provided, the depth of the center of gravity of the clubhead 1 of the iron golf club can be made deeper.

Figure 9A:
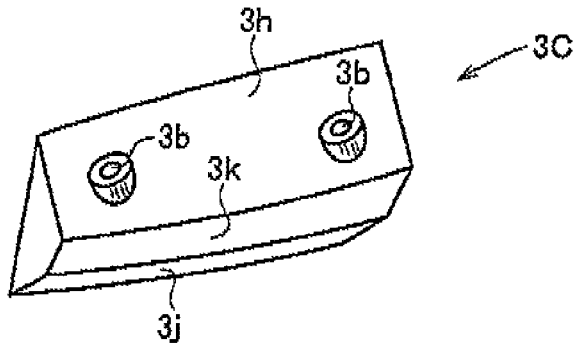
FIGS. 9A and 9B show explanatory drawings depicting a back member and a clubhead of an iron golf club according to a different embodiment.
Figure 9B:
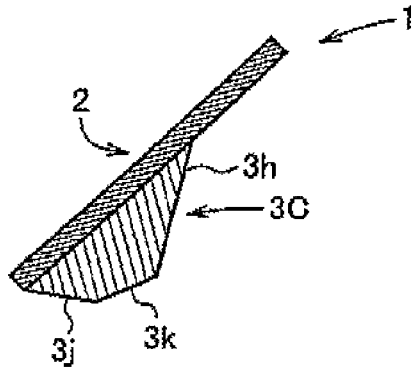
Figure 10A:
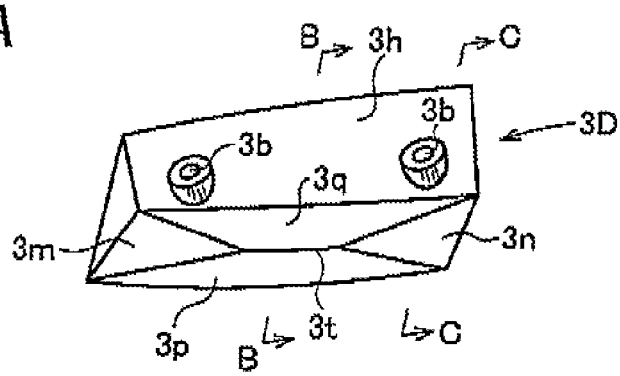
FIGS. 10A to 10C show explanatory drawings depicting a back member used in the embodiment.
Figure 10B:
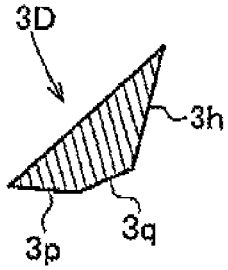
Figure 10C:
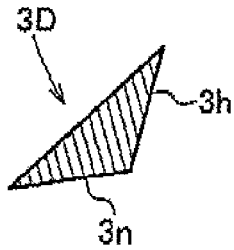

FIG. 9A is a perspective view of a different back member 3C as seen from the rear thereof, and FIG. 9B is a sectional view, which is similar to FIG. 3, of a portion of a clubhead 1 in which the back member 3C is attached to a head main body 2.

In this back member 3C, a sole surface includes two sole surfaces such as a front edge side sole surface 3*j* and a rear edge side sole surface 3*k*, which extend downwards to join together so as to form a projection.

In FIG. 9, the joining angle between the sole surfaces. 3*j*, 3*k* is preferably not less than 90° and less than 180° or is more preferably in the range of 120° to 160°.

With the sole surface projecting downwards in the way described above, when the player misplays or duffs a golf ball (that is when the player misjudges his or her swing so that the golf club strikes the ground behind the golf ball before hitting it), the sole becomes easy to slide on the grass, and therefore, the risk of misplaying the golf ball can be reduced. In addition, an easy explosion shot can be attained as a bunker shot.

In the back member 3C shown in FIGS. 9A and 9B, the joining line between the front edge side sole surface 3*j* and the rear edge side sole surface 3*k* extends from a heel side to a toe side of the back member 3C, whereby the sole surface is formed into a gable roof-like shape in whole. However, the sole surface may be formed into a pyramidal roof-like shape like a sole surface of a back member 3D shown in FIGS. 10A to 10C. The sole surface of the back member 3D includes four sloping surfaces such as sole surfaces 3*m*, 3*n*, 3*p*, 3*q*. A heel side sole surface 3*m* and a toe side sole surface 3*n* have a triangular shape, and a front edge side sole surface 3*p* and a rear edge side sole surface 3*q* have a substantially trapezoidal shape. The front edge side sole surface 3*p* and the rear edge side sole surface 3*q* join along a ridge 3*t*.

Apices of the triangular sole surfaces 3*m*, 3*n* are positioned at both ends of the ridge 3*t*. A length of the ridge 3*t* is preferably in the range of 10 to 80% and is more preferably in the range of 50 to 70% of a toe-to-heel length of the back member 3D.

The other configurations of the back members 3C, 3D remain the same as those of the back member 3, and like reference numerals are given to denote like constituent portions to those of the back member 3.

Figure 11:
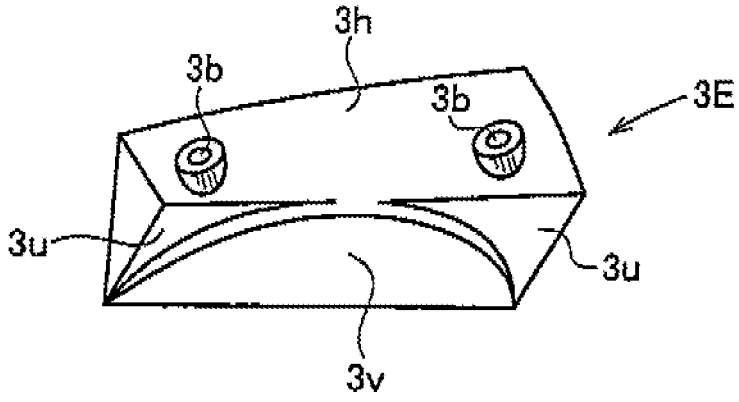
FIG. 11 is an explanatory drawing depicting a back member used in the embodiment.

FIG. 11 is a perspective view of a back member 3E as seen from the rear thereof. A sole surface of this back member 3E includes a semicircular or segmental projecting table portion 3*v*. The projecting table portion 3*v* has a segment shape enclosed between an arc and a chord which is constituted by a front lower edge of the back member 3D, and the projecting table portion 3*v* gets thicker as it extends towards the rear of the sole surface. On the sole surface, portions lying closer to a toe side and a heel side than the projecting table portion 3*v* are formed into flat surfaces 3*u* which are flush with a sole surface 2*s* of a head main body 2 of a clubhead 1 of an iron golf club.

The other configurations of the back member 3E remain the same as those of the back member 3, and like reference numerals are given to denote like constituent portions to those of the back member 3. The clubhead of the iron golf club which includes the back member 3E has a larger bounce angle than that of the clubhead of the iron golf club shown in FIGS. 1 to 5 and hence is more suitable for a bunker shot. In addition, when the player is at address with the face of the clubhead of the iron golf club which has the back member 3E opened (with an open face of the clubhead), the heel side flat surface 3*u* which lies closer to the heel sides than the projecting table portion 3*v* is grounded at the heel side sole surface. Because of this, the whole face surface of the clubhead lies close to the ground, which makes it easy that a leading edge of the clubhead strikes a position between the golf ball and the ground. Because of this, a shot with the face of the clubhead opened to increase the loft angle (for example, a lob shot) is easily made.

Figure 12A:
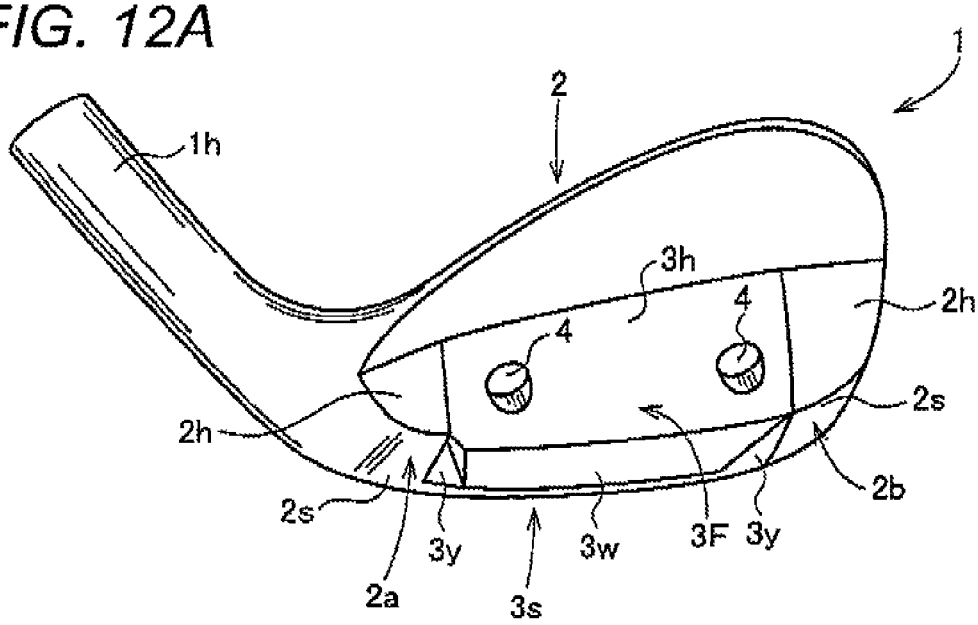
FIGS. 12A to 12C show explanatory drawings depicting a clubhead of an iron golf club having a different back member.
Figure 12B:
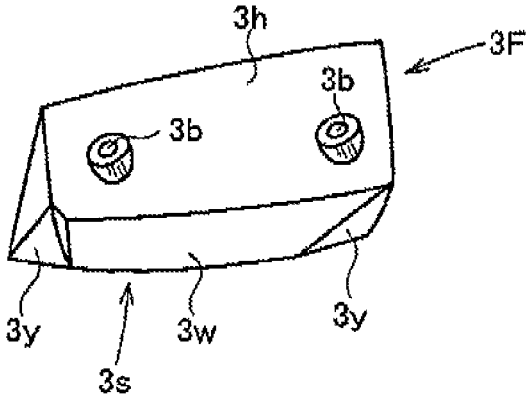
Figure 12C:
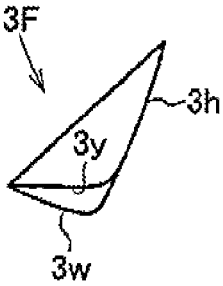

FIG. 12A is a perspective view of a clubhead 1 of an iron golf club to which a back member 3F is attached to a head main body 2 as seen from the rear and below thereof, FIG. 12B is a perspective view of the back member 3F as seen from the rear and below thereof, and FIG. 12C is a side view of the back member 3F.

A toe side portion and a heel side portion of a sole surface of the back member 3F are formed into flat surfaces 3*y* which are flush with a sole surface 2*s* of the head main body 2, and a portion lying between the flat surfaces 3*y*, 3*y* is formed into a projecting table portion 3*w* which projects downwards. The projecting table portion 3*w* has a trapezoidal shape in which a side along a front edge and a side along a rear edge are parallel. This trapezoid is shaped so that the length of the side facing the front edge is shorter than the length of the side facing the rear edge. The projecting table portion 3*w* gets thicker as it extends to the rear.

The other configurations of the back member 3F are the same as those of the back member 3, and like reference numerals are given to denote like constituent portions to those of the back member 3. This back member 3F has the flat surface 3*y* which lies closer to the heel side than the projecting table portion 3*w* on the sole surface thereof, and therefore, the same advantage as that given by the back member 3E shown in FIG. 11 can also be obtained.

Figure 13A:
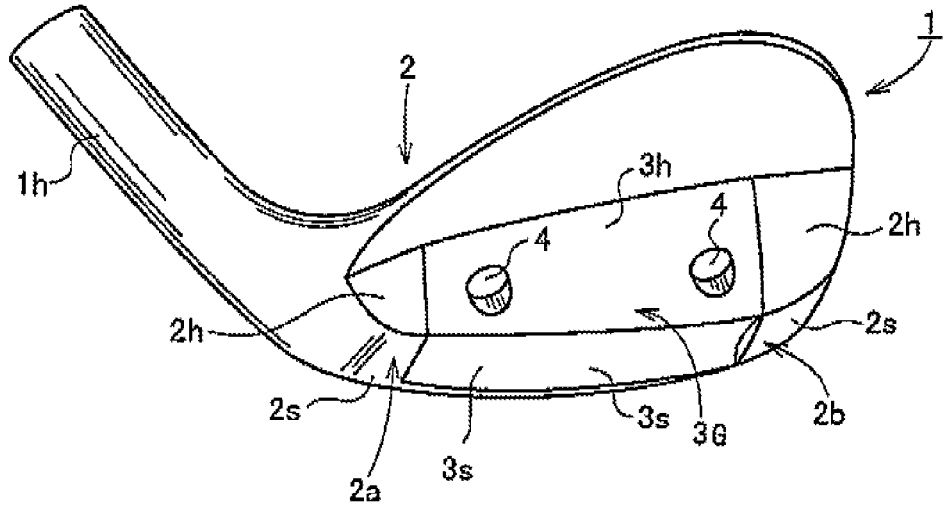
FIGS. 13A and 13B show explanatory drawings depicting a clubhead of an iron golf club having a different back member.
Figure 13B:
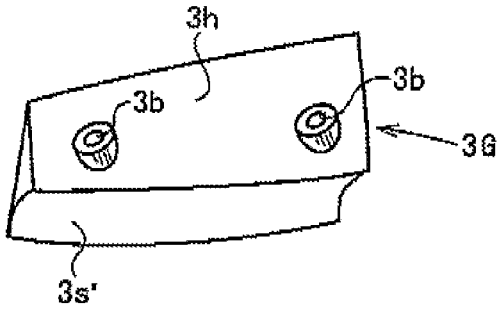

FIG. 13A is (a perspective view of a clubhead 1 of an iron golf club to which a back member 3G is attached to a head main body 2 as seen from the rear and below thereof, and FIG. 13B is a perspective view of the back member 3G as seen from the rear and below thereof.

A sole surface 3*s*' of this back member 3G is formed into a concavely curved surface which recedes upwardly. A cross section of the sole surface 3*s*' taken along a face-to-back direction (the direction of a rearward extension of a ball flight line) has an arc-like shape.

The other configurations of the back member 3G are the same as those of the back member 3, end like reference numerals are given to denote like constituent portions to those of the back member 3. The clubhead of the iron golf club which includes the back member 3G has a small resistance between the sole surface and the ground or sand when a shot is made.

Figure 14A:
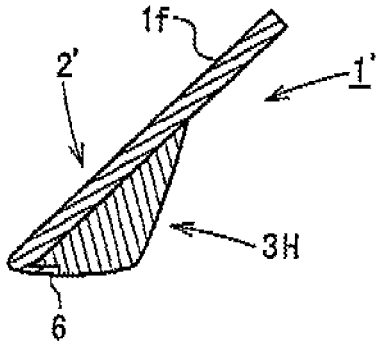
FIGS. 14A and 14B show explanatory drawings depicting a clubhead of an iron golf club having a different back member.
Figure 14B:
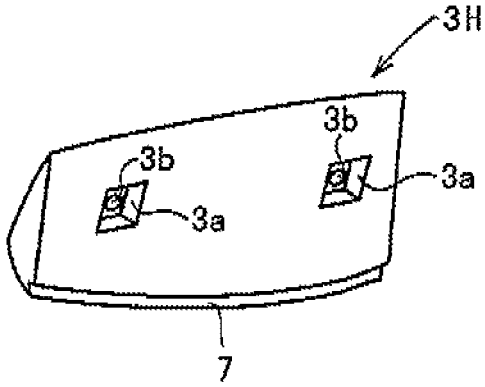

In a clubhead 1' of an iron golf club shown in FIGS. 14A and 14B, a hook portion 6 is provided on a rear surface of a lower end of a head main body 2' so as to project therefrom, and an engagement portion 7 is provided along a lower edge of a front end of a back member 3H, and this engagement portion 7 is made up of a recess portion with which the hook portion 6 engages.

The hook portion 6 extends to the rear so as to form part of a sole surface of the clubhead 1' of the iron golf club. The back member 3H is superposed on the head main body 2' so that the recess portion 7 is brought into engagement with the hook portion 6 and is fixed thereto with bolts 4 (not shown in FIGS. 14A and 14B).

The other configurations of the clubhead 1' of the iron golf club remain the same as those of the clubhead 1 of the iron golf club, and like reference numerals are given to like constituent portions those of the clubhead 1. According to the clubhead 1' of the iron golf club, the back member 3H is fixed to the head main body 2' firmly.

Figure 15A:
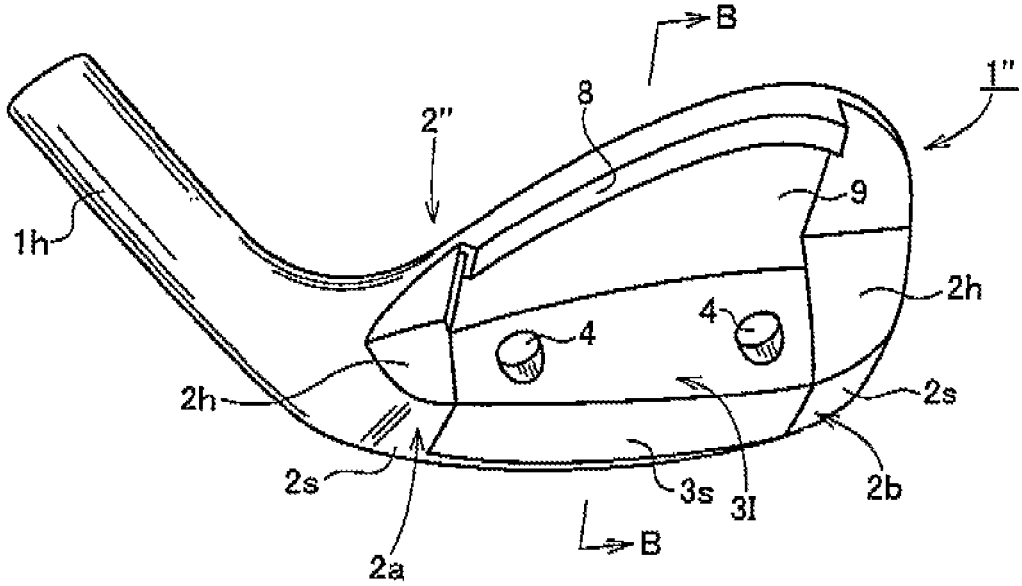
FIGS. 15A and 15B show explanatory drawings depicting a clubhead of an iron golf club having a different back member.
Figure 15B:
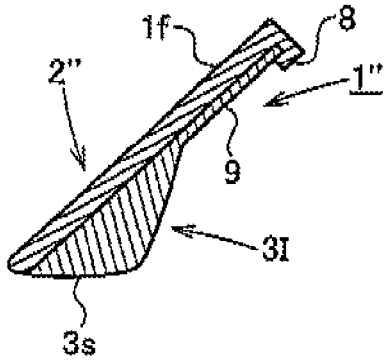

FIGS. 15A and 15B show a clubhead 1" of an iron golf club in which a hook portion 8 is provided along an upper edge of a rear surface of a head main body 2" and an upwardly extending portion 9 is provided on a back member 3I, so that an upper end of the upwardly extending portion 9 is inserted into the hook portion 8 for engagement. FIG. 15A is a perspective view of the clubhead 1" of the iron golf club as seen from the rear and below thereof, and FIG. 15B is a sectional view taken along the line B-B at FIG. 15A.

The hook portion 8 is provided so as to project to the rear from an upper edge of a face surface of the head main body 2". As shown in FIG. 15B, this hook portion 8 has an inverted L-shaped cross section as seen in a face-to-back direction.

Figure 16A:
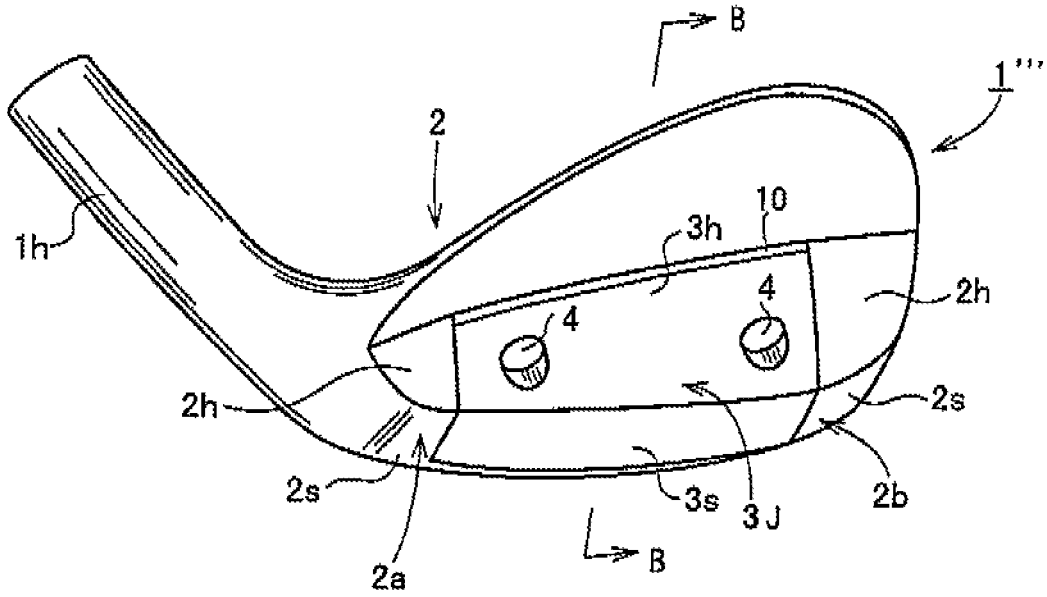
FIGS. 16A and 16B show explanatory drawings depicting a clubhead of an iron golf club having a different back member.
Figure 16B:
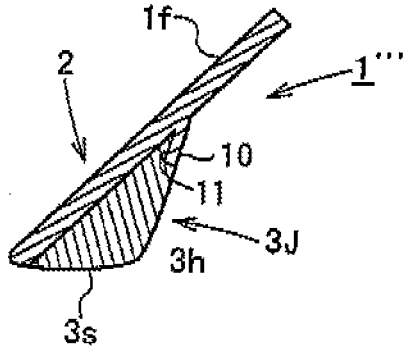

FIG. 16A is a perspective view of a clubhead 1'" of an iron golf club which includes a back member 3J, and FIG. 16B is a sectional view taken along the line B-B in FIG. 16A.

A hook portion 10 is provided on a head main body 2'" of the clubhead 1'" of the iron golf club so as to connect together upper ends of toe side and heel side protuberant portions 2*a*, 2*b* thereof. A recess portion 11 is provided in an upper edge portion of the back member 3J so that the hook portion 10 is brought into engagement therewith.

In FIGS. 16A and 16B, the hook portion 10 is provided to extend continuously between the protuberant portions 2*a*, 2*b*. However, the hook portion 10 may be provided partially between the protuberant portions 2*a*, 2*b*.

The other configurations of the clubheads 1", 1'" of the iron golf clubs remain the same as those of the clubhead 1 of the iron golf club, and like reference numerals are given to denote like constituent portions to those of the clubhead 1. In these clubheads 1", 1'" of the iron golf clubs, the back members are attached to the head main bodies firmly.

Any of the embodiments that have been described heretofore is one of the examples of the invention, and hence, the invention may be embodied in any other forms than those described above. For example, a back member may be fixed to a head main body with a magnet.

Figure 17A:
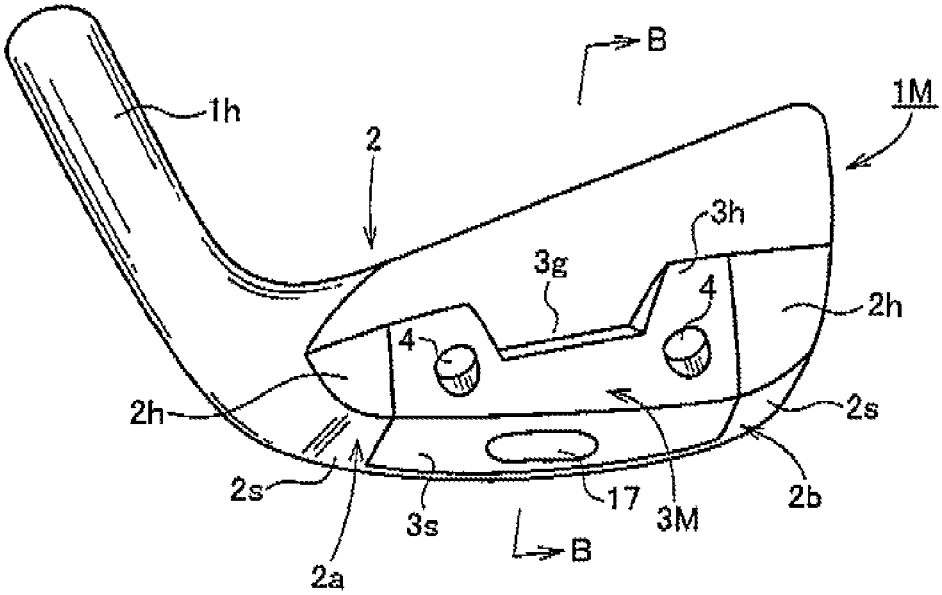
FIGS. 17A and 17B show explanatory drawings depicting a back member and a clubhead of an iron golf club according to the invention.
Figure 17B:
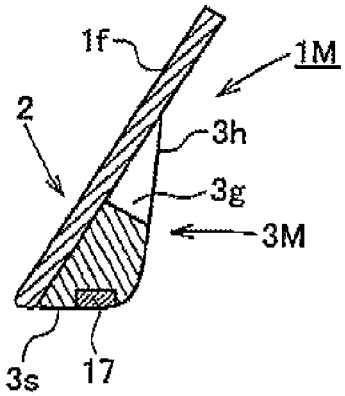

In the embodiments that have been described heretofore, the invention is described as being applied to the wedge. However, as has been described before, the invention can be applied to any type of iron golf club including a long iron, a middle iron and a short iron. FIGS. 17A and 17B show a clubhead 1M of an iron golf club when the invention is applied to a middle iron. FIG. 17A is a perspective view of the clubhead 1M as seen from the rear and below thereof, and FIG. 17B is a sectional view taken along the line B-B at FIG. 17A.

This clubhead 1M of the iron golf club has a steeper loft angle than the respective clubheads of the iron golf clubs of the embodiments above. A similar lower portion 3*g* to that of the back member 3A shown in FIGS. 7A to 7C is provided in a back member 3M of the clubhead 1M of the iron golf club. However, a recess portion 3*i* may be provided in place of the lower portion 3*g*. A weight material 17 made of a material having a high specific gravity such as tungsten or a tungsten alloy is embedded in a sole surface 3*s* of the back member 3M, so that the center of gravity of the clubhead of the iron golf club is made lower. The other configurations of the clubhead of the iron golf club are the same as those of the clubhead shown in FIG. 1, and like reference numerals are given to denote like constituent portions to those of the clubhead in FIG. 1.

The weight material 17 is secured to the back member through crimping, however, internally threaded holes are provided in the back member, so that machine screws made of a high-gravity material are screwed into the internally threaded holes for attachment of the weight material 17 to the back member. As this occurs, by using machine screws having different specific gravities, the weight of the clubhead can be adjusted.

Figure 18A:
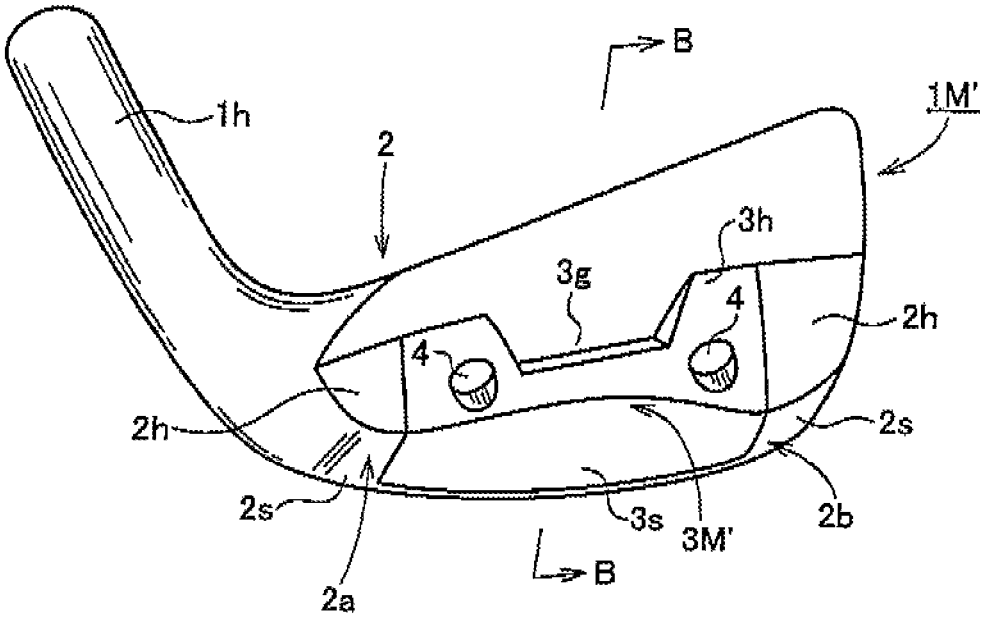
FIGS. 18A and 18B show explanatory drawings depicting a back member and a clubhead of an iron golf club according to the embodiment of the invention.
Figure 18B:
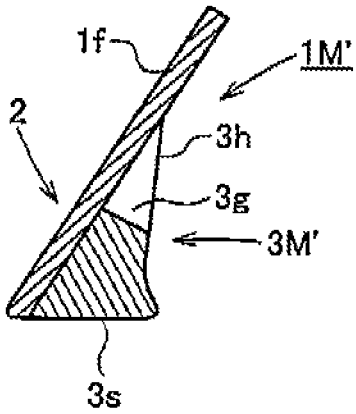

In a clubhead 1M' of an iron golf club shown in FIGS. 18A and 18B, the weight material 17 is omitted, and instead, the width of a sole portion 3*s* of a back member 3M' is increased, so as to lower the center of gravity of the clubhead 1M'. The other configurations of the clubhead 1M', shown in FIGS. 18A and 18B, are the same as those of the clubhead 1M, shown in FIGS. 17A and 17B, and like reference numerals are given to denote like constituent portions to those of the clubhead 1M.

What is claimed is:

1. A clubhead of an iron golf club comprising:

a head main body including a face portion and a hosel portion;

a back member including a sole surface and a back surface; and a fixing member configured to detachably fix the back member to the head main body, wherein a height of an intermediate portion of the back member is lower than a height of a toe-side portion of the back member and a height of a heel-side portion of the back member, and a recess is provided in a head main body side surface of the intermediate portion of the back member.

2. The clubhead according to claim 1, wherein the back member is located at a central portion of the clubhead in a toe-to-heel direction.

3. The clubhead according to claim 2, wherein a length of the back member in the sole surface with respect to the toe-to-heel direction is in a range of 25 to 80 mm.

4. The clubhead according to claim 1, wherein a toe side, a heel side and a face portion side of the sole surface of the clubhead are defined by a sole surface of the head main body, and a portion of the sole surface of the clubhead, which is surrounded by the toe side, the heel side and the face portion side of the sole surface, is defined by a sole surface of the back member.

5. The clubhead according to claim 4, wherein a part of the sole surface of the back member projects toward a downside of the sole surface of the head main body.

6. The clubhead according to claim 4, wherein a part of the sole surface of the back member recedes toward an upside of the sole surface of the head main body.

7. The clubhead according to claim 1, wherein an intermediate portion of the sole surface of the back member with respect to a face-to-back direction projects toward a downside of a face-side portion and a back-side portion of the surface of the back member.

8. The clubhead o according to claim 1, wherein the fixing member is a bolt.

9. The clubhead according to claim 8, wherein:

a projecting portion is provided at a part of a back surface of the head main body;

a recess hole is provided in a front surface of the back member so that the projecting portion fits the recess hole;

a bolt insertion hole is provided so as to pass from the recess hole to a back surface of the back member; and the back member is fixed to the head main body when the bolt, passed through the bolt insertion hole, is screwed into an internally threaded hole provided in the projecting portion.

10. A clubhead of an iron golf club comprising:

a head main body including a face portion and a hosel portion;

a back member including a sole surface and a back surface;

a fixing member configured to detachably fix the back member to the head main body;

a projecting portion is provided at a part of a back surface of the head main body;

a recess hole is provided in a front surface of the back member so that the projecting portion fits the recess hole; and a bolt insertion hole is provided so as to pass from the recess hole to a back surface of the back member, wherein the back member is fixed to the head main body when the bolt, passed through the bolt insertion hole, is screwed into an internally threaded hole provided in the projecting portion, and the fixing member is a bolt.

11. The clubhead according to claim 10, wherein the back member is located at a central portion of the clubhead in a toe-to-heel direction.

12. The clubhead according to claim 11, wherein a length of the back member in the sole surface with respect to the toe-to-heel direction is in a range of 25 to 80 mm.

13. The clubhead according to claim 10, wherein a height of an intermediate portion of the back member is lower than a height of a toe-side portion of the back member and a height of a heel-side portion of the back member.

14. The clubhead according to claim 13, wherein a recess is provided in a head main body side surface of the intermediate portion of the back member.

15. The clubhead according to claim 10, wherein a toe side, a heel side and a face portion side of the sole surface of the clubhead are defined by a sole surface of the head main body, and a portion of the sole surface of the clubhead, which is surrounded by the toe side, the heel side and the face portion side of the sole surface, is defined by a sole surface of the back member.

16. The clubhead according to claim 15, wherein a part of the sole surface of the back member projects toward a downside of the sole surface of the head main body.

17. The clubhead according to claim 15, wherein a part of the sole surface of the back member recedes toward an upside of the sole surface of the head main body.

18. The clubhead according to claim 10, wherein an intermediate portion of the sole surface of the back member with respect to a face-to-back direction projects toward a downside of a face-side portion and a back-side portion of the surface of the back member.

* * * * *